United States Patent [19]

Kano

[11] Patent Number: 4,956,751

[45] Date of Patent: Sep. 11, 1990

[54] ILLUMINATION EQUIPMENT

[76] Inventor: Tetsuhiro Kano, Lobenhofferstrasse 49, 8600 Bamberg, Fed. Rep. of Germany

[21] Appl. No.: 365,930

[22] Filed: Jun. 12, 1989

[30] Foreign Application Priority Data

Jun. 16, 1988 [DE] Fed. Rep. of Germany ..... 3820576

[51] Int. Cl.[5] ..... F21V 9/00

[52] U.S. Cl. ..... 362/1; 362/231

[58] Field of Search ..... 362/1, 2, 231

[56] References Cited

U.S. PATENT DOCUMENTS

| | | | |
|---|---|---|---|
| 1,324,008 | 12/1919 | D'Humy | 362/1 |
| 2,169,355 | 8/1939 | Cohn | 362/1 |
| 2,282,693 | 5/1942 | Abadie | 362/1 |
| 2,451,580 | 10/1948 | Schwinger | 362/1 |
| 2,725,461 | 11/1955 | Amour | 362/1 |
| 2,831,966 | 4/1958 | Porteous | 362/2 |
| 4,570,209 | 2/1986 | Wittlin | 362/1 |

OTHER PUBLICATIONS

A. R. Robertson, "Computation of Correlated Color Temperature and Distribution Temperature", Journal of the Optical Society of America, vol. 56, No. 11, pp. 1528–1535 (Nov. 1968).

Gunter Wyszecki, "Development of New CIE Standard Sources for Colorimitry", Die Farbe 19 (1970); pp. 43–76.

*Primary Examiner*—Carroll B. Dority

*Attorney, Agent, or Firm*—Brumbaugh, Graves, Donohue & Raymond

[57] ABSTRACT

An apparatus for illumination generating artificial light which resembles natural light as much as possible comprises a light source radiating substantially in the blue-green region, such as a fluorescent lamp (16*a,b,c,d*) and at least one incandescent lamp (18). Prior to exiting from a housing (12) of the illumination equipment the light of the light source radiating blue-green is reflected at least once from a white wall (14). This applies also, in part at least, to the light of the incandescent lamp (18).

5 Claims, 3 Drawing Sheets

ILLUMINATION EQUIPMENT

FIELD OF THE INVENTION

The instant invention relates to illumination equipment, comprising a housing and at least one light source radiating substantially in the blue-green region of the light spectrum and at least one light source radiating substantially in the red-orange-yellow region of the light spectrum. Such illumination equipment may be a movable lamp or a large-area illuminating system, for example, one that is integrated in the ceiling of a room.

BACKGROUND OF THE INVENTION

The illumination equipment according to the invention is intended to produce light which resembles natural light as closely as possible, for instance daylight as provided by the sun. The specification proper will be preceded by an explanation of some fundamental terms relating to the colors of light and color rendering so as to illustrate the problems involved and the concept of the invention.

The term "light" is used to designate electromagnetic radiation capable of including the light stimulus in the eye, in other words being visible. As is well known, the visible radiation (light) lies in the wavelength range from about 380 nm to 780 nm.

So-called spectral distributions are indicated to characterize the distribution of the radiant energy of light sources in relation to the wavelength. The corresponding diagrams, as a rule, present the wavelength on the abscissa, while the spectral radiation flux is plotted on the ordinate.

The radiation flux is defined as the power transmitted by radiation. Its unit is the watt (W). The spectral radiation flux is measured in watt per meter (W/m).

The light stimulus caused in the eye by electromagnetic radiation depends not only on the radiation flux but quite essentially also on the spectral composition of the radiation.

In the illumination technique, therefore, a so-called "luminous flux" is defined; it results from an evaluation of the radiation flux by resorting to the spectral luminous efficiency. Further details on this topic may be found in textbooks on light technique, e.g. the "Handbuch der Beleuchtung", Girardet-Verlag, Essen and in German industrial standards DIN 5033 and 6169.

In the light technique, moreover, a so-called color temperature is defined. A light source is compared with the so-called black body radiator (also referred to as Planck's radiator). As is well-known, a Planck's radiator is a temperature radiator which is at thermal equilibrium. The spectral properties of many light sources (such as fluorescent tubes) differ widely from the behavior of a black body radiator. A so-called correlated color temperature is associated with such types of light; it is given by the difference in the type of color sensed, between the type of color of a particular light source and the corresponding point on the Planckian curve, reaching a minimum value.

In the case of incandescent lamps the color locus lies exactly on the curve of Planck's radiator (because a glow lamp is a black body radiator). For this reason, a precise color temperature can be stated for incandescent lamps.

The above mentioned "correlated color temperature" can be calculated by methods such as developed, for instance, by A. R. Robertson ("Computation of Correlated Color Temperature and Distribution Temperature", A. R. Robertson, Journal of the Optical Society of America, November 1968).

The natural daylight provided by the sun changes its spectral composition constantly in the course of the day and, moreover, depends on the weather, clouds, etc. The CIE has defined daylight by formulae by which the spectrum of daylight of any desired color temperature between 4000 K and 25000 K can be determined by calculation.

In the German industrial standards (DIN) the color rendering of light sources is defined as the relation between the original color of an object and its reproduction color, either exclusively under different illumination or in addition after having passed a transmission process. Color rendering properties of light sources are defined by the general color reproduction index "Ra" (see DIN 6169, part 2). Planck's radiator is used as the type of reference light in the process of characterizing the general color rendering index Ra if the light source to be designated has a color temperature of less than 5000 K. If the color temperature is equal to or higher than 5000 K the daylight as defined by the CIE is used for designation.

Therefore, if light is to resemble natural daylight as much as possible, it must be adapted specifically in respect of many parameters because the common artificial light sources differ more or less widely in their above mentioned parameters from the values of natural daylight.

Daylight does not correspond to the light of the black body radiator. The similarity of an artificial light source with daylight in general can be found out by comparing three parameters, namely the color temperature, the general color reproduction index Ra, and the spectral radiation distribution. Artificial light which has a color temperature in correspondence with daylight of more than 5000 K, a very good color rendering index Ra of more than 85, and a spectrum which is similar to that of daylight, will have much resemblance to daylight on the whole.

It is desirable in many fields to produce artificial light which has characteristics as similar as possible to those of daylight. This applies, for example, to fashion show rooms, professional make-up studios, exhibition halls, etc.

It is known that xenon lamps can be used to provide light which largely corresponds to daylight. However, such lamps are used for special purposes only, e.g. with movie theater projectors, because they involve a high risk of explosion and their operating conditions are expensive.

In the journal DIE FARBE 19 (1970), no.1/6, pages 43≧76 Gunter Wyszecki describes a combination of an ultraviolet fluorescent lamp and a tungsten halogen lamp. It comprises filtering for the tungsten lamp.

SUMMARY OF THE INVENTION

It is an object of the invention to provide illumination equipment by simple means which will radiate light largely in correspondence with natural daylight.

The solution of that problem and modifications thereof are specified in the claims.

The illumination equipment provided by the invention to meet the above object comprises a housing in which at least two different light sources are combined, namely at least one light source radiating substantially in the blue-green region of the light spectrum, and at least one light source radiating red-orange-yellow, the light of the light source radiating blue-green being reflected substantially at least once from a surface before leaving the housing, and the light of the light source radiating red-orange-yellow likewise being reflected from said surface, at least in part, prior to issuing from the housing, whereby both radiations are blended.

Light thus produced can be used to illuminate a room and/or an object almost as if natural daylight were given.

The word "blending" as used in the instant application is meant to express that different rays impinge on the same surface which reflects them.

Especially a white surface is suitable as a surface which blends the blue-green radiation and the red-orange radiation. Instead of a white surface, a mirrored wall may be employed which has its surface dulled. Furthermore, it is possible to blend the different rays by means of a gray wall. That, of course, means having to put up with a loss in intensity.

If there is sunshine, natural daylight has a color temperature between approximately 5000 K and 7500 K. Under cloudy skies the color temperature is higher. True, there are fluorescent lamps which have a corresponding color temperature of e.g. 5000 K or 5500 K, a very good Ra index (greater than 85), and a spectrum similar to that of daylight. And yet the light of such fluorescent lamps differs from natural daylight because natural daylight of such color temperature is "warm" and very "clear". The admixture according to the invention of light from a light source radiating red-orange-yellow or from an incandescent lamp (black body radiator) provides light which, on the whole, is "warm" and "clear". The admixture of light from a fluorescent lamp whose color temperature is higher than that of daylight makes it possible to achieve a color temperature corresponding to daylight, a very good color reproduction index Ra, and a very similar spectrum.

The invention preferably makes use of common fluorescent lamps, which are rather inexpensive, as the light source which radiates mainly in the blue-green region. The preferred light source according to the invention to supply the mainly red-orange-yellow radiation are incandescent lamps. The blending according to the invention of the light of the fluorescent lamp and the light of a Planck's radiator (incandescent lamp) provides illumination which largely corresponds to natural daylight if the two types of light are at least partly mixed by reflection from a white wall.

The reason why a mixture of light from fluorescent lamps and light from a red-orange light source provides not only a color temperature corresponding to natural daylight but also a very good color reproduction index Ra is as follows: Fluorescent lamps radiate light in the blue-green region. An incandescent lamp, on the other hand, radiates light substantially in the red-orange-yellow region of the spectrum. The spectrum of the blended light has a much greater resemblance to that of natural daylight than the light of customary fluorescent lamps.

Natural daylight specifically has the properties of being very "warm" and "clear". "Warm light" means that the spectral composition contains a sufficient proportion of red, especially the region near the infrared boundary. Although this spectral region does not contribute much to the brightness of a light source, it has an essential influence on the appearance of an illuminated object. For instance, human skin color reflects this spectral region rather strongly.

In fluorescent lamps each fluorescent substance has its own specific radiation. Therefore, fluorescent lamps can yield different light colors if the fluorescent substances are mixed. But only a few fluorescent substances are known which have high proportions in the red region near the infrared boundary. In practice, such fluorescent substances are hardly used because they yield little light.

Another aspect to be taken into account in generating artificial light as similar as possible to natural daylight is the fact that, speaking in terms of light technique, the sun practically is a point light source. A point light source produces distinct contrast between the illuminated side of an object and the shaded side. It is this sharp contrast which makes daylight appear "clear".

Fluorescent lamps are in sharp contrast to the above. The fluorescent substance at the inside surface of the tube first absorbs the uv radiation and generates total diffused light. Therefore, a distinct contrast cannot result.

Admittedly, light similar to daylight can be produced by combining an incandescent lamp with a filter. That, however, has serious disadvantages, particularly higher power losses and short service life of the lamps.

The illumination equipment according to the invention overcomes those disadvantages of the known fluorescent lamps while, at the same time, exploiting their favorable properties, such as energy efficiency, durability, etc.

The advantages of illumination equipment according to the invention above all are that it permits an illuminated object (especially human skin) to appear naturally, and that there are many possibilities of simulating also the changes of the natural daylight in response to the weather, clouds, etc. In this respect the invention is based on the following finding:

If an object is illuminated directly by fluorescent lamps in combination with a lamp which radiates red-orange-yellow (e.g. an incandescent lamp), in other words if no blending of radiation according to the invention is effected, a desired light color can be obtained only on the irradiated side of the object and not on the shaded side. The shady side is bluish.

This "bluish shadow" is created by diffused light of the fluorescent lamps. The diffused light can reach the sides in the shade, whereas the light of the incandescent lamp is beamed only on the "sunny side". Now, if a human face is illuminated, such bluish shadows are highly undesirable. With the illumination equipment according to the invention the shaded side of an illuminated human face appears as if it were irradiated by natural sunlight. A mild contrast can be achieved by the illumination equipment according to the invention between the sides in the "sun" and in the shade of the irradiated object. To accomplish that, the color temperature of the light can be adjusted by adjusting the light mixture from the two light sources (blue-green on the one hand and red-orange on the other hand) such that the light issuing from the housing to the outside has a color temperature higher than 7000 K. To obtain mild contrast on the illuminated object, a special modification of the invention makes it possible to sharply reduce the proportion of the red-orange-yellow radiation which hits the object directly (i.e. without reflection). The direct red-orange-yellow radiation also may be suppressed entirely.

As an alternative, mild contrast on the illuminated object may be achieved by furnishing the red-orange-yellow radiating light source with a frosted or white coated glass bulb.

Different daylight conditions, such as according to the position of the sun and the weather conditions, can be simulated by varying the composition of the blended light.

No filter is required for the illumination equipment according to the invention as the desired light spectrum can be obtained by the selection of the fluorescent substances.

Advantageous modifications of the invention are presented in the subclaims.

BRIEF DESCRIPTION OF THE DRAWING

The invention will be described further, by way of example, with reference to the accompanying drawings, in which.

DESCRIPTION OF THE PREFERRED EMBODIMENTS

Figure 1:
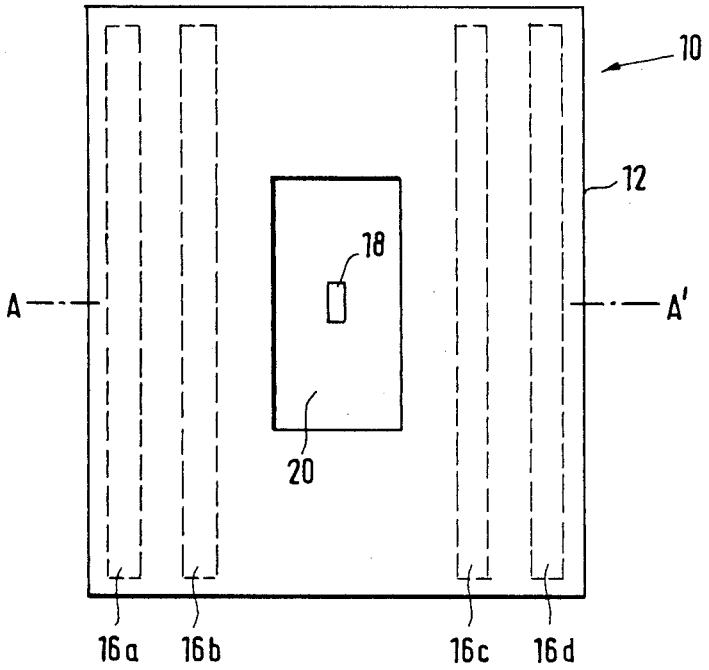
FIG. 1 is a top plan view of a first embodiment of the illumination equipment.

The illumination equipment illustrated in FIG. 1 is a compact, portable lamp 10. The shape of a housing 12 may be gathered from FIG. 2. The inside wall 14 of the housing 12 has a white coating.

Figure 2:
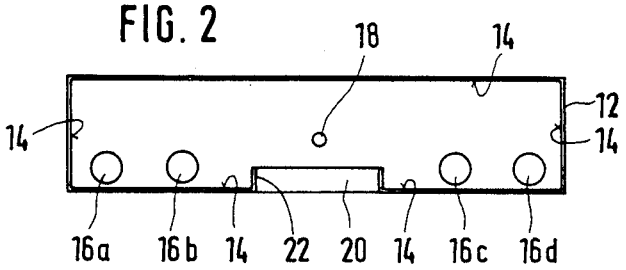
FIG. 2 is a sectional view along lines A—A' in FIG. 1.

Fluorescent lamps 16*a,b,c,* and *d* which are known per se are arranged inside the housing 12, as shown in FIGS. 1 and 2, such that the light they give which includes strong green-blue components as compared to natural daylight cannot exit directly from the housing 12 but instead is first reflected at least once from the white inside wall 14.

An incandescent lamp 18 is arranged in the housing 12 in such manner that its light in part issues directly from an opening formed in the housing 12 rather than being reflected from the inside wall 14. Another part of the light radiated by the incandescent lamp 18 first impinges on the white inside wall 14 where it is reflected together with light from the fluorescent lamps 16*a,b,c,d* before it finally also exits from the opening 20 in the housing 12. Barriers 22 likewise having a white coating at the inside assure that no light from the fluorescent lamps will exit directly from the housing 12 through the opening 20.

The incandescent lamp may be replaced by any other light source radiating in the red-orange-yellow region of the electromagnetic spectrum, for example a high pressure sodium vapor lamp.

The light sources used as radiators in the red-orange-yellow region are of a type which has little extent in space so as to be regarded in first approximation as a point light source. It is likewise possible to arrange a plurality of such light sources in the illumination equipment.

The total light radiated by lamp 10 to the outside through the opening thus is composed at each radiation angle of components which originate from the incandescent lamp and from the fluorescent lamps. In this manner adaptation to the quality of natural daylight is obtained.

The share of the individual components may be varied selectively. In this manner different daylight conditions can be simulated.

In the preferred embodiment shown, the fluorescent lamp has a color temperature of at least 7000 K and its greatest spectral radiant flux of continuous spectrum lies in the range between 440 and 500 nm. This has proved to be especially favorable. Preferably one of the substances below is used as the fluorescent substance in the fluorescent lamp:

$Ca_5(PO_4)_3F,Cl:Sb$
$Ca_{10}(PO_4)_6F,Cl:Sb$
$(Ba, Ca, Mg)_{10}(PO_4)_6Cl_2:Eu$
$Sr_2P_2O_7:Sn$
$Ba_2P_2O_7:Ti$
$2SrO.0.84P_2O_5.0.16B_2O_3:Eu$
$CaWO_4:Pb$
$MgWO_4:Pb$

These substances may be used either alone or mixed with one of the following additives:

$(Sr,Mg)_3(PO_4)_2:Sn$
$CaSiO_3:Pb,Mn$
$Ca_{10}(PO_4)_6F,Cl:Sb,Mn$
$Zn_2SiO_4:Mn$
$MgGa_2O_4:Mn.$

Figure 3:
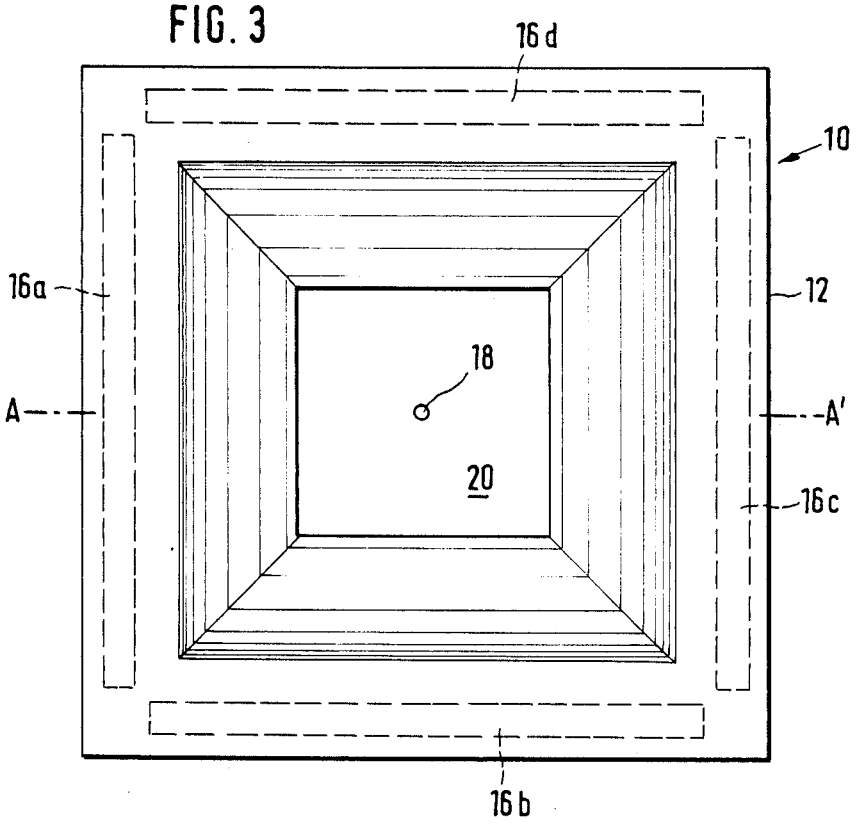
FIG. 3 is a top plan view of a second embodiment of illumination equipment.
Figure 4:
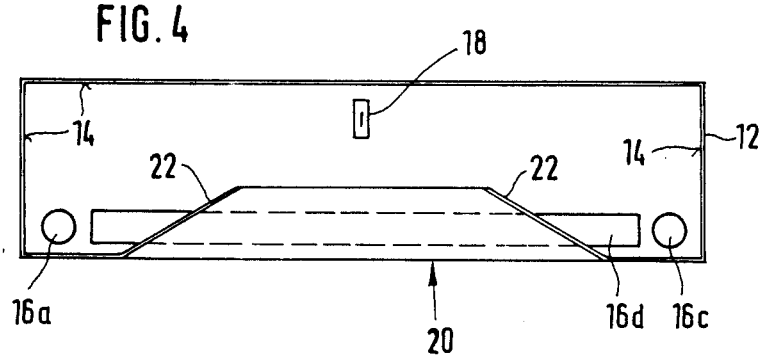
FIG. 4 is a sectional view along lines A—A' in FIG. 3.

The embodiment shown in FIGS. 3 and 4 largely corresponds to the one according to FIGS. 1 and 2 so that corresponding structural members are designated by like reference numerals and the embodiment is self-explanatory from the drawing. As shown in FIG. 4 the opening 20 is surrounded by a barrier 20 of truncated pyramid shape.

Modifications of the embodiments represented in FIGS. 1 to 4 may be furnished with annular fluorescent lamps which are known per se. It is likewise possible to use a plurality of incandescent lamps which, however, preferably should be disposed close together or such that the light of only one incandescent lamp will leave the housing directly, whereas the light from the other incandescent lamps first impinges on the inside wall 14.

In the embodiment shown, the incandescent lamps 18 comprise a clear glass bulb or a frosted or white coated glass bulb. In the latter case, however, the heated filament should be visible from outside when the incandescent lamp is switched on.

Figure 5:
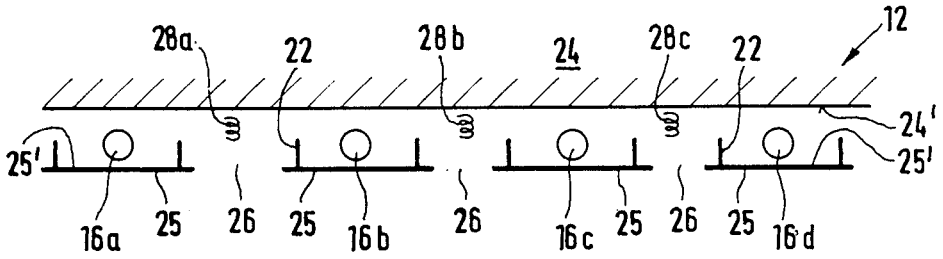
FIG. 5 shows another embodiment of illumination equipment integrated in the ceiling of a room.

FIG. 5 presents yet another embodiment with which the illumination equipment is integrated in the ceiling of a room which is to be illuminated, for instance a room in which fashion shows take place, a make-up studio of a theater, and the like. The ceiling 24 of the room has a continuous white coating on the inner surface 24'. Together with an intermediate ceiling 25 the ceiling 24 defines the housing 12. Openings 26 are formed in the intermediate ceiling 25. The fluorescent lamps 16*a,b,c,* and *d* are arranged in such manner that their light cannot pass directly through the openings 26. If necessary, barriers 22 are provided for that purpose and they, too, are provided with a white coating. Filaments 28*a,b,* and *c* are disposed above the openings 26 in such manner that light exiting from the openings 26, when both the incandescent lamps and the fluorescent lamps are switched on, always is composed of components made up of reflected light from the incandescent lamps and reflected light from the fluorescent lamps. Furthermore, the radiation also includes proportions of direct radiation from the incandescent lamps, proportions which, however, can be varied by varying the position of the incandescent lamps. In accordance with a further development of the invention, therefore, the individual light sources, especially the incandescent lamps may be arranged movably so as to render the composition of the radiated light variable.

The embodiments shown also may be modified such that, in addition to the light sources mentioned, a separate light source is provided which is adapted to be switched on individually so that the light produced can be compared with the light furnished by the separately provided light source. Moreover, it may be provided that the incandescent lamps and the fluorescent lamps are selectively switched on individually.

Claims:

1. Illumination equipment for producing light closely resembling natural daylight, comprising:

a housing having a reflective inner surface, an upper wall and an opening oppositely disposed from said upper wall;

at least one light source radiating substantially in the blue-green region of the light spectrum positioned at a location within said housing at which radiation therefrom can exit from said opening only after having been reflected at least once from the reflective inner surface of said housing; and at least one light source radiating substantially in the red-orange-yellow region of the light spectrum positioned within said housing at a location at which a portion of the radiation therefrom exits directly from said opening without having been reflected from the reflective surface of the housing and a portion of the radiation therefrom is blended by reflection on the reflective inner surface of said housing with radiation from said at least one blue-green light source prior to exiting from said opening, whereby the light radiated from said opening is composed, at each radiation angle, of components which originate from said at least one blue-green light source and from said at least red-orange-yellow light source.

2. Illumination equipment for producing light closely resembling natural daylight, comprising:

a housing having a reflective inner surface, an upper wall and an opening oppositely disposed from said upper wall;

at least one fluorescent lamp of circular shape radiating substantially in the blue-green region of the light spectrum positioned within said housing and surrounding said opening at a location at which radiation therefrom can exit from said opening only after having been reflected at least once from the reflective inner surface of said housing; and at least one light source radiating substantially in the red-orange-yellow region of the light spectrum positioned within said housing at a location at which radiation therefrom is blended by reflection on the reflective inner surface of said housing with blue-green radiation from said fluorescent lamp prior to exiting said opening, whereby the light radiated from said opening is composed, at each radiation angle, of components which originate from said fluorescent lamp and from said at least one red-orange-yellow light source.

3. Illumination equipment for producing light closely resembling natural daylight, comprising:

a housing having a reflective inner surface, an upper wall, an opening oppositely disposed from said upper wall, said housing having barriers positioned therein surrounding said opening and forming a radiation blending surface;

at least one light source radiating substantially in the blue-green region of the light spectrum positioned at a location within said housing at which radiation therefrom can exit from said opening only after having been reflected at least once from a reflective inner surface of said housing; and at least one light source radiating substantially in the red-orange-yellow region of the light spectrum positioned within said housing at a location at which radiation therefrom is blended by reflection on the reflective inner surface of said housing and on the blending surface of said barriers with radiation from said at least one blue-green light source prior to exiting from said opening, whereby the light radiated from said opening is composed, at each radiation angle, of components which originate from said at least one blue-green light source and from said at least one red-orange-yellow light source.

4. Illumination equipment for producing in a room light closely resembling natural daylight, comprising:

a housing having a reflective inner surface, an upper wall and an opening oppositely disposed from said upper wall;

at least one light source radiating substantially in the blue-green region of the light spectrum positioned at a location within said housing at which radiation therefrom can exit from said opening only after having been reflected at least once from the reflective inner surface of said housing; and at least one light source radiating substantially in the red-orange-yellow region of the light spectrum positioned within said housing at a location at which radiation therefrom is blended by reflection on the reflective inner surface of said housing with radiation from said at least one blue-green light source prior to exiting from said opening, whereby the light radiated from said opening is composed, at each radiation angle, of components which originate from said at least one blue-green light source and from said at least one red-orange-yellow light source, wherein the upper wall of said housing is formed by the ceiling of said room and the opening is formed in an intermediate ceiling of the room.

5. Illumination equipment as claimed in claim 2, wherein each light source radiating red-orange-yellow comprises a glass bulb selected from the group of glass bulbs that are clear, frosted, and white coated in which a heated filament is visible.

* * * * *